US010422502B2

(12) United States Patent
Groenewald et al.

(10) Patent No.: US 10,422,502 B2
(45) Date of Patent: Sep. 24, 2019

(54) MOTOR VEHICLE LAMP AND MOTOR VEHICLE

(71) Applicant: GM GLOBAL TECHNOLOGY OPERATIONS LLC, Detroit, MI (US)

(72) Inventors: Sebastian Groenewald, Mainz (DE); Alexander Schmidt, Ruesselsheim (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/881,951

(22) Filed: Jan. 29, 2018

(65) Prior Publication Data

US 2018/0216795 A1 Aug. 2, 2018

(30) Foreign Application Priority Data

Jan. 28, 2017 (DE) ..... 10 2017 000 805

(51) Int. Cl.

| | |
|---|---|
| ***F21S 43/40*** | (2018.01) |
| ***F21S 43/33*** | (2018.01) |
| ***F21S 43/249*** | (2018.01) |
| ***F21S 43/14*** | (2018.01) |
| ***F21S 43/31*** | (2018.01) |
| ***F21S 43/27*** | (2018.01) |
| ***F21S 43/237*** | (2018.01) |
| ***F21S 43/245*** | (2018.01) |
| ***F21S 43/247*** | (2018.01) |
| *F21Y 115/10* | (2016.01) |
| *F21S 45/10* | (2018.01) |

(52) U.S. Cl.

CPC ..... *F21S 43/40* (2018.01); *F21S 43/14* (2018.01); *F21S 43/237* (2018.01); *F21S 43/245* (2018.01); *F21S 43/247* (2018.01); *F21S 43/249* (2018.01); *F21S 43/27* (2018.01); *F21S 43/31* (2018.01); *F21S 43/33* (2018.01); *F21S 45/10* (2018.01); *F21Y 2115/10* (2016.08)

(58) Field of Classification Search

CPC ..... F21S 43/40; F21S 43/33; F21S 43/249; F21S 43/14; F21S 43/31

See application file for complete search history.

(56) References Cited

U.S. PATENT DOCUMENTS

| | | | | |
|---|---|---|---|---|
| 4,977,487 | A * | 12/1990 | Okano | B60Q 1/50 362/555 |
| 2005/0063169 | A1* | 3/2005 | Erber | F21S 43/40 362/600 |
| 2013/0201709 | A1* | 8/2013 | Natsume | B60Q 1/00 362/511 |
| 2014/0247615 | A1* | 9/2014 | Fadi | F21S 43/14 362/511 |

(Continued)

*Primary Examiner* — Anabel Ton

(74) *Attorney, Agent, or Firm* — Lorenz & Kopf, LLP

(57) ABSTRACT

A motor vehicle light includes an optical waveguide system and a reflector. The optical waveguide system is arranged in the focal line of the reflector and is configured to project a plurality of light beams onto the reflector to generate a light signature having a plurality of parallel light beams emitting from the motor vehicle light. The motor vehicle light may include a housing with a transparent cover lens in order to protect the optical waveguide system from environmental influences such as sunlight and mechanical stresses.

20 Claims, 1 Drawing Sheet

(56) References Cited

U.S. PATENT DOCUMENTS

| | | | | |
|---|---|---|---|---|
| 2015/0138803 | A1* | 5/2015 | Salter | B60Q 1/2661<br>362/510 |
| 2017/0028905 | A1* | 2/2017 | Irgang | B60Q 1/22 |
| 2018/0170039 | A1* | 6/2018 | Yamada | B41J 2/04588 |
| 2018/0290587 | A1* | 10/2018 | Fimeri | B60Q 1/2665 |
| 2019/0011109 | A1* | 1/2019 | Potter | G02B 6/001 |

* cited by examiner

MOTOR VEHICLE LAMP AND MOTOR VEHICLE

CROSS-REFERENCE TO RELATED APPLICATION

This application claims priority to German Patent Application No. 102017000805.1, filed Jan. 28, 2017, which is incorporated herein by reference in its entirety.

TECHNICAL FIELD

The present disclosure pertains to a motor vehicle light with an optical waveguide system and a reflector, as well as to a motor vehicle.

BACKGROUND

Motor vehicle lights in the front region of a motor vehicle serve as turn signals on the one hand and for illuminating the roadway on the other hand. Motor vehicle lights in the tail region of motor vehicles fulfill multiple functions, including marking the motor vehicle, serving as backup lights, indicating turn signals, featuring brake lights, providing hazard warning lights and the like.

Motor vehicle lights also have aesthetic functions and represent an important identification feature for different motor vehicle manufacturers. Each motor vehicle manufacturer may have a light signature that makes the motor vehicle brand and/or distinguishable from other manufacturers and/or models. This has resulted in the development of a broad variety of shapes of motor vehicle lights and designers are constantly searching for new creative leeway.

Nonetheless, the light signature should not compromise the safety and the functionality of the lights. This includes sufficient luminous intensity, as well as the most uniform light emission possible. Furthermore, the regulations may exist that define specified strict guidelines with respect to the applicable technologies and certain technologies cannot be used in the exterior lighting of motor vehicles for legal reasons. Within the scope of SAE regulations, for example, it is not permitted to use, among other things, translucent materials in the exterior lighting of motor vehicles.

There is a trend toward providing lights with a linear character. Expensive solutions and/or solutions that required significant structural space were required so far in order to implement this within the scope of the applicable laws. One known option consists of using a large number of optical waveguide systems (for example LEDs). This approach is costly and requires intensive maintenance. Another option consists of providing a large distance between the light source and the inner lens of a motor vehicle exterior light fixture.

SUMMARY

Accordingly, the present disclosure provides a lighting configuration, as well as a motor vehicle, that enhances motor vehicle lights in such a way that a linear light signature can be realized in a cost-efficient and spaced-saving fashion, as well as in compliance with various regulatory and/or legal requirements. In particular, a motor vehicle light includes an optical waveguide system and a reflector. The reflector has a focal line in which the optical waveguide system is arranged. A space-saving reflection technology, which generates a linear light signature, can be realized due to the fact that the reflector defines a focal line and the optical waveguide system is arranged in the focal line. The use of translucent materials is not required in this case such that the motor vehicle light complies with the corresponding regulations and/or legal requirements. The reflector and/or the optical waveguide system may be configured in such a way that the illumination is adequately homogenous, i.e. homogenous to the desired degree.

According to a first enhancement, the reflector is injection-molded. Injection molding makes it possible to cost-efficiently produce a sufficiently precise reflector shape, as well as a broad variety of possible shapes.

In another enhancement, the surface of the reflector is at least partially or entirely structured. In other words, the reflector may be a single piece. Corresponding structures may be defined by a sufficiently coarse granularity of the reflection surface for creating a diffuse light distribution due to scattering, by pyramid patterns, line patterns, honeycomb patterns or the like. The structure may be realized differently in different areas in order to produce a desired light distribution.

In another enhancement, the surface of the reflector may be partially or entirely metallized. The reflectivity of the surface can thereby be increased. This can serve for accentuating or for altogether increasing the luminosity of the motor vehicle light.

In a further enhancement, the reflector may include a polymer material. Corresponding polymers can be highly reflective, weatherproof and insusceptible to soiling.

In another enhancement, the reflector may feature an enclosure for the optical waveguide system so as to reduce the manufacturing and installation efforts and furthermore makes it possible to accurately position the optical waveguide system in the focal line. In addition, the enclosure may form a protective cover for the optical waveguide system and prevent direct light emission without prior reflection on the reflector. The luminous efficiency can furthermore be improved.

According to another enhancement, the optical waveguide system may be arranged in a lateral region of the reflector. In this case, the reflector is configured in such a way that the focal line coincides with a lateral region. A corresponding lateral region may include, for example, of a left, right, upper or lower lateral region. In this way, the illumination pattern is not interrupted by the optical waveguide system. Instead, the optical waveguide system is arranged on a boundary of the illumination pattern.

According to another enhancement, the reflector is realized in a shell-shaped fashion. The shell may have a two-dimensional or three-dimensional curvature. A shell-shaped design simplifies the integration into the body design of the motor vehicle.

According to a further enhancement, the motor vehicle light may feature a housing with a transparent cover. In this embodiment, the reflector and the optical waveguide system are arranged in the interior of the housing.

According to another enhancement, the focal line may be realized straight or bent or curved. This makes it possible to implement optical and safety-related specifications. The motor vehicle light can simultaneously form part of the overall optical design of the motor vehicle.

In another enhancement, the optical waveguide system may include at least one light source and at least one optical waveguide. The optical waveguide makes it possible to influence the illumination pattern and, if applicable, to achieve a more homogenous light distribution with fewer light sources such that the costs of the motor vehicle light are reduced. Furthermore, the light source can therefore be arranged in a lateral region of the optical waveguide system.

According to another enhancement, the optical waveguide system features at least one diffusion element. The diffusion element makes it possible to distribute light, which is laterally incident into the optical waveguide, uniformly over the length of the optical waveguide. According to an embodiment, the diffusion element may be bonded onto the optical waveguide system.

According to another enhancement, the optical waveguide system may be realized linearly. The optical waveguide system can thereby follow the focal line of the reflector.

In another enhancement, the light source may include one or more LEDs. LEDs are compact, durable and highly luminous. In addition, they are relatively insensitive to weathering.

In another enhancement, the optical waveguide may be realized in the form of a diffusion lens. In this way, the illumination of the reflector can be improved and a more homogenous light distribution can be achieved.

A first coordinate aspect pertains to a motor vehicle with at least one motor vehicle light of the above-described type.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
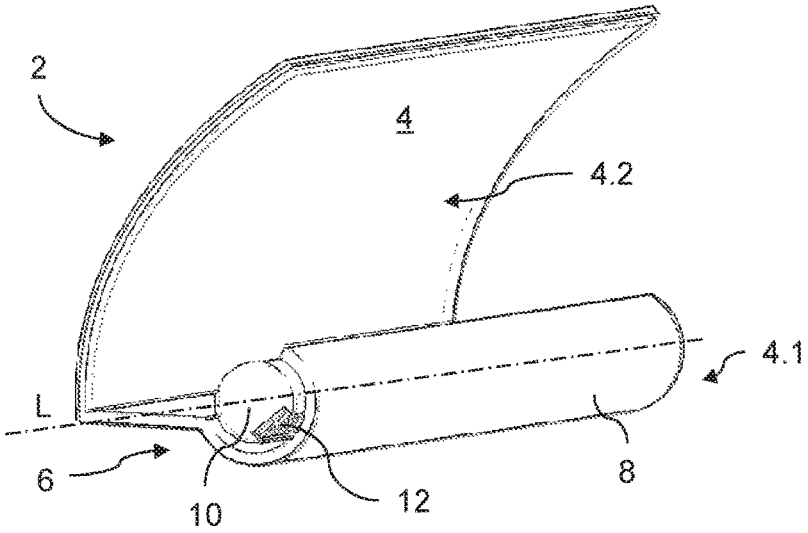
FIG. 1 shows a perspective view of a motor vehicle light.

FIG. 1 shows a perspective view of a motor vehicle light 2. The motor vehicle light 2 is installed in a motor vehicle 1. The motor vehicle light 2 includes a reflector 4, as well as an optical waveguide system 6.

The reflector 4 is essentially realized in the form of a shell that is curved in two dimensions. The reflector 4 has a focal line L (illustrated in the form of a broken line). The optical waveguide system 6 is arranged in the focal line L. The reflector 4 is realized in one piece. The reflector 4 consists of a highly reflective polymer. The reflector 4 is manufactured in an injection molding process.

An enclosure 8 is formed in a lateral region 4.1 of the reflector 4. The optical waveguide system 6 is held in the enclosure 8. The enclosure 8 conceals the optical waveguide system 6 from the viewing side B. In this way, direct light emission is prevented.

The enclosure 8 may be made of the same material as the remaining reflector 4 such that light emitted by the optical waveguide system 6 is reflected back and the luminous efficiency is increased. The motor vehicle light 2 may include a housing with a transparent cover lens in order to protect the optical waveguide system 6 from environmental influences such as sunlight and mechanical stresses.

A surface 4.2 of the reflector 4 is realized in a granular fashion in order to produce slightly diffuse scattering of the light of the optical waveguide system 6 on the surface 4.2. The light emission of the motor vehicle light 2 is thereby homogenized.

The optical waveguide system 6 includes an optical waveguide 10, as well as a diffusion element 12. The diffusion element 12 is bonded onto the optical waveguide 10.

A light source, e.g. in the form of one or more LEDs, is arranged on an end face of the optical waveguide element 6. Multiple white or identically colored light sources may be used. Alternatively, it is also possible to use multiple light sources with different colors for producing various colors, if applicable also with additive color mixing.

The optical waveguide 10 acts as a diffusion lens and uniformly distributes the light of the LEDs of the diffusion element 12. The light distribution of the diffusion element 12 is thereby improved.

Figure 2:
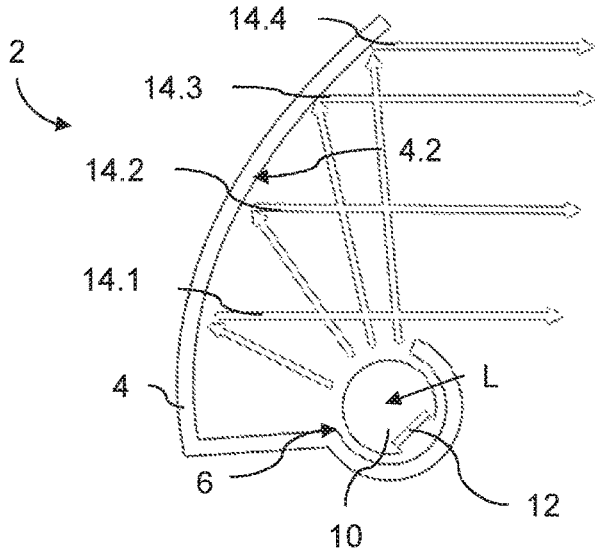
FIG. 2 shows a side view of the motor vehicle light with a light distribution.

FIG. 2 shows a side view of the motor vehicle light 2 with the light distribution produced thereby. This figure shows multiple light beams 14.1 to 14.4 that are emitted at the reflector 4 from the optical waveguide system 6. Since the light beams 14.1 to 14.4 are all radially emitted at the surface 4.2 of the reflector 4 from the focal line L, the light beams 14.1 to 14.4 are essentially emitted into the surroundings parallel to one another. A linear illumination into the sheet plane is created due to the shape of the reflector 4.

Figure 3:
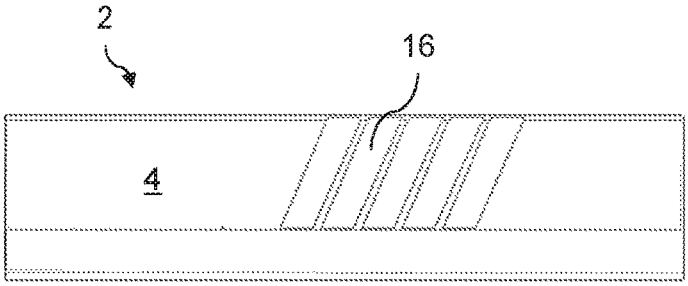
FIG. 3 shows a front view of the motor vehicle light.

FIG. 3 shows a front view of the motor vehicle light 2. The reflector 4 has a straight focal line L. In alternative embodiments, a curved focal line may be provided instead of a straight focal line. Strips 16 of metallic material are applied onto the reflector 4. These metallic strips 16 produce a defined visible light structure because they are more reflective than the surface 4.2 of the reflector 4.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment as contemplated herein. It should be understood that various changes may be made in the function and arrangement of elements described in an exemplary embodiment without departing from the scope of the invention as set forth in the appended claims.

What is claimed is:

1. A motor vehicle light comprising: an optical waveguide system having an optical waveguide element, the optical waveguide system configured with a light source on an end face of the optical waveguide element, a reflector including a reflective surface having a focal line, and a lateral region extending from the reflective surface and supporting the optical waveguide system, wherein the optical waveguide system is arranged in the focal line of the reflector and is configured to project a plurality of light beams through the optical waveguide system and reflect off the reflector to generate a light signature having a plurality of parallel light beams emitting from the motor vehicle light.

2. The motor vehicle light according to claim 1, wherein the reflective surface comprises a shell-shaped structure having a two-dimensional curvature.

3. The motor vehicle light according to claim 1, wherein the reflector comprises a one-piece component.

4. The motor vehicle light according to claim 1, wherein the reflective surface comprises a metallized surface.

5. The motor vehicle light according to claim 1, wherein the reflector comprises an injection-molded reflector.

6. The motor vehicle light according to claim 1, wherein the reflector comprises a polymeric reflector.

7. The motor vehicle light according to claim 1, wherein the lateral region further comprises an enclosure for the optical waveguide system, wherein the enclosure is arranged along the focal line of the reflector.

8. The motor vehicle light according to claim 1, wherein the focal line is a straight focal line.

9. The motor vehicle light according to claim 1, wherein the optical waveguide system comprises a plurality of light sources, each light source configured to project a light beam through the optical waveguide system and reflect off the reflector.

10. The motor vehicle light according to claim 1, wherein the optical waveguide system comprises a diffusion element.

11. The motor vehicle light according to claim 1, wherein the optical waveguide system comprises a linear waveguide system.

12. The motor vehicle light according to claim 1, wherein the optical waveguide system comprises one or more LED.

13. A motor vehicle light comprising:

a reflector including a shell-shaped structure having a two-dimensional curvature and a reflective surface defining a focal line, a lateral region extending from the reflective surface and an enclosure supporting an optical waveguide system, wherein the enclosure is arranged along the focal line of the reflector; and a linear waveguide system arranged in the focal line of the reflector and having a plurality of light sources, each light source configured to project a light beam through the optical waveguide system and reflect off the reflector to generate a light signature having a plurality of parallel light beams emitting from the motor vehicle light.

14. The motor vehicle light according to claim 13, wherein the reflective surface comprises a metallized surface.

15. The motor vehicle light according to claim 13, wherein the reflector comprises a one-piece component.

16. The motor vehicle light according to claim 13, wherein the optical waveguide system comprises a diffusion element.

17. The motor vehicle light according to claim 13, wherein the focal line is a straight focal line.

18. The motor vehicle light according to claim 17, wherein the optical waveguide system comprises a linear waveguide system.

19. The motor vehicle light according to claim 13, wherein the plurality of light sources comprises one or more LED.

20. A motor vehicle light comprising:

a reflector that has a two-dimensional curvature, a reflective surface defining a focal line, and a lateral region extending from the reflective surface;

an enclosure disposed in the lateral region and supporting the optical waveguide system, wherein the enclosure is arranged along the focal line of the reflector; and an optical waveguide system arranged in the focal line of the reflector and having an optical waveguide, a diffusion element, and a light source;

wherein the light source is configured to project a light beam through the optical waveguide system and reflect off the reflector to generate a light signature having a plurality of parallel light beams emitting from the motor vehicle light.

* * * * *